US011600436B2

(12) United States Patent
Sano

(10) Patent No.: US 11,600,436 B2
(45) Date of Patent: Mar. 7, 2023

(54) IGNITION COIL FOR INTERNAL COMBUSTION ENGINE

(71) Applicant: DENSO CORPORATION, Kariya (JP)

(72) Inventor: Masafuyu Sano, Kariya (JP)

(73) Assignee: DENSO CORPORATION, Kariya (JP)

( * ) Notice: Subject to any disclaimer, the term of this patent is extended or adjusted under 35 U.S.C. 154(b) by 596 days.

(21) Appl. No.: 16/451,305

(22) Filed: Jun. 25, 2019

(65) Prior Publication Data

US 2019/0392986 A1 Dec. 26, 2019

(30) Foreign Application Priority Data

Jun. 26, 2018 (JP) ..... JP2018-120947

(51) Int. Cl.

| | |
|---|---|
| ***H01F 38/12*** | (2006.01) |
| ***H01F 27/28*** | (2006.01) |
| ***H01F 27/24*** | (2006.01) |
| ***H01F 27/29*** | (2006.01) |

(52) U.S. Cl.

CPC ..... *H01F 38/12* (2013.01); *H01F 27/24* (2013.01); *H01F 27/2823* (2013.01); *H01F 27/29* (2013.01); *H01F 2038/122* (2013.01)

(58) Field of Classification Search

CPC ..... H01F 38/12; H01F 27/24; H01F 27/2823; H01F 27/29; H01F 2038/122; H01F 27/2828

See application file for complete search history.

(56) References Cited

U.S. PATENT DOCUMENTS 5,170,767 A * 12/1992 Wada ..... H01T 13/44 123/169 PA
5,225,801 A 7/1993 Ida et al.
7,312,681 B1 * 12/2007 Maeda ..... H01F 41/10 29/606
2009/0033451 A1 * 2/2009 Akimoto ..... H01F 38/12 336/96
2013/0284157 A1 * 10/2013 Deguchi ..... F02P 23/00 123/634
2014/0226253 A1 * 8/2014 Kawai ..... H01F 38/12 361/263

FOREIGN PATENT DOCUMENTS

| | | |
|---|---|---|
| JP | H09-045571 | 2/1997 |
| JP | 2001-093759 | 4/2001 |
| JP | 2008-021794 | 1/2008 |
| JP | 2010-10163 | 1/2010 |
| JP | 2011-176167 | 9/2011 |
| JP | 2016-051787 | 4/2016 |

* cited by examiner

*Primary Examiner* — Mang Tin Bik Lian
(74) *Attorney, Agent, or Firm* — Nixon & Vanderhye P.C.

(57) ABSTRACT

An ignition coil for an internal combustion engine is provided.

The ignition coil includes: a primary coil and a secondary coil magnetically coupled to each other; a second spool which the secondary coil is wound around; and a connection terminal connected to a high voltage side of the secondary coil and supported by a terminal support portion provided at the second spool. The terminal support portion includes an insertion hole portion allowing the connection terminal to be inserted in an insertion direction as a coil radial direction. The connection terminal includes a protrusion protruding outside the connection terminal in a direction orthogonally crossing the insertion direction. The protrusion is engaged to the insertion hole portion from inward in the coil radial direction.

10 Claims, 17 Drawing Sheets

IGNITION COIL FOR INTERNAL COMBUSTION ENGINE

CROSS-REFERENCE TO RELATED APPLICATION

This application is based on and claims the benefit of priority from earlier Japanese Patent Application No. 2018-120947 filed Jun. 26, 2018, the description of which is incorporated herein by reference.

BACKGROUND

Technical Field

The present disclosure relates to an ignition coil

Description of the Related Art

Ignition coils for internal combustion engines are known. For example, an ignition coil includes, in a casing, a primary coil, a secondary coil, a second spool, a connection terminal and a high voltage output terminal. The primary coil and a secondary coil are mutually magnetically coupled. The second spool includes the secondary coil wound around an outer periphery portion thereof.

SUMMARY

The present disclosure provides an ignition coil for an internal combustion engine.

The ignition coil includes: a primary coil and a secondary coil magnetically coupled to each other; a second spool which the secondary coil is wound around; and a connection terminal connected to a high voltage side of the secondary coil and supported by a terminal support portion provided at the second spool.

DETAILED DESCRIPTION OF THE PREFERRED EMBODIMENTS

First Embodiment

Figure 1:
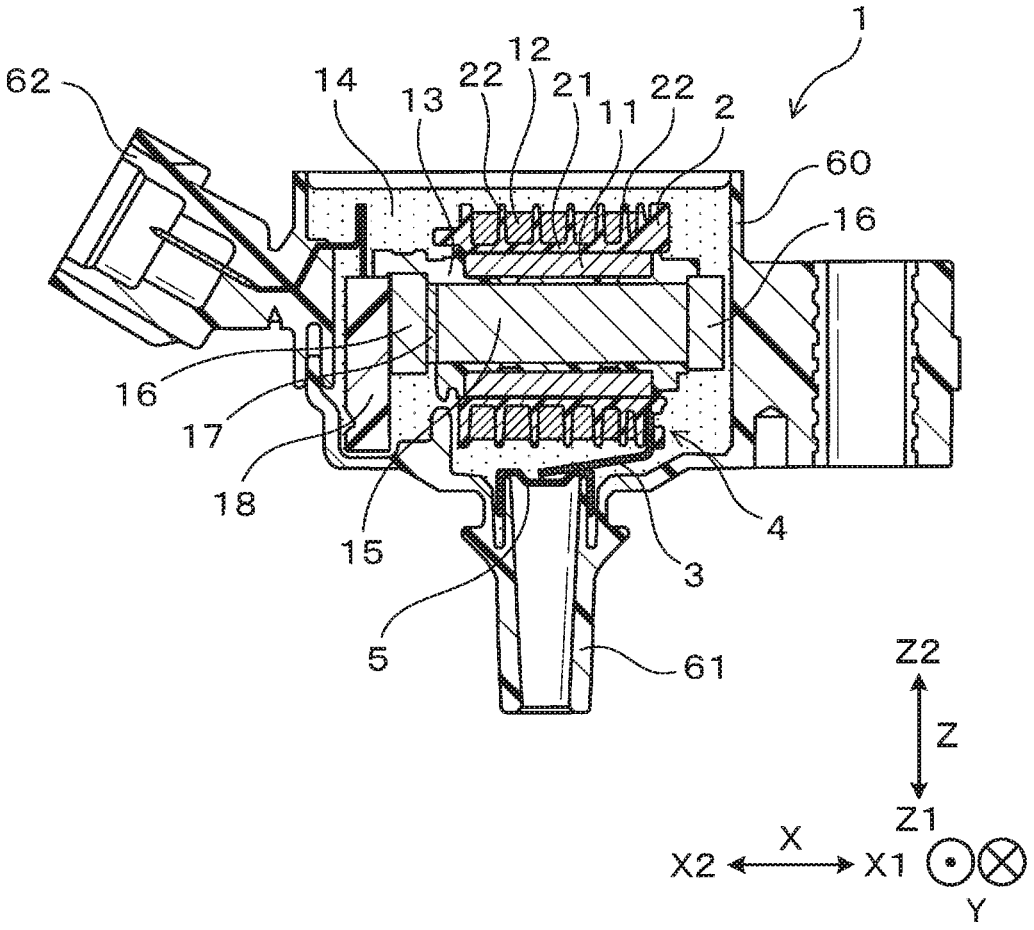
FIG. 1 is a cross-sectional view of an ignition coil according to a first embodiment of the present disclosure.

With reference to FIGS. 1 to 9, an embodiment of an ignition coil for an internal combustion engine will be described. As shown in FIG. 1, an ignition coil 1 of the internal combustion engine according to the first embodiment includes a primary coil 11, a secondary coil 12, a second spool 2, and a connection terminal 3. The primary coil 11 and the secondary coil 12 are magnetically coupled. The secondary coil is wound around the second spool 2. The connection terminal 3 is connected to the high voltage side of the secondary coil 12. As shown in FIGS. 1 to 5, the connection terminal 3 is supported by a terminal support portion 4 of the second spool 2. As shown in FIGS. 4, 5, 7 and 8, the terminal support portion 4 includes an insertion hole portion 40 allowing the connection terminal 3 to be inserted in an insertion direction (hereinafter referred to as Z-direction) as an one of coil radial directions.

The connection terminal 3 includes a protrusion 311 protruding outside the connection terminal 3 in the Y-direction orthogonally crossing the Z-direction. The protrusion 311 is engaged to the insertion hole 40 from inward in the coil radial direction. In other words, the insertion hole 40 locks the protrusion 311 from outward in the coil radial direction of the protrusion 311. Hereinafter, the first embodiment will be described in more detail.

In the present specification, the X direction is defined as a direction in which the winding shaft of the secondary coil 12 extends. Also, a side in which the connection terminal 3 of the second spool 2 is disposed is defined as an X1 side, and its opposite side is defined as X2 side. The coil radial direction refers to a radial direction of the secondary coil 12. One of direction in myriads of coil radial directions radially extending from the center axis of the winding shaft is defined as the Z direction. In the Z-direction, a side in which the connection terminal 3 is provided in the second spool 2 is defined as a Z1 side and the opposite side is defined as a Z2 side. The X direction, the Y direction and the Z direction orthogonally cross each other. Also, the circumferential direction of the secondary coil 12 is defined as a coil circumferential direction.

The ignition coil 1 according to the first embodiment is utilized as a means for applying high voltage to an ignition plug provided in the internal combustion engine of vehicle or cogeneration apparatus.

As shown in FIG. 1, the primary coil 11 and the secondary coil 12 are arranged to be in concentric circles. That is, these coils are arranged to be radially overlapped concentric circles. The primary coil 11 is wound around the first spool 13 which is disposed to be inserted inside the second spool 2.

Figure 7:
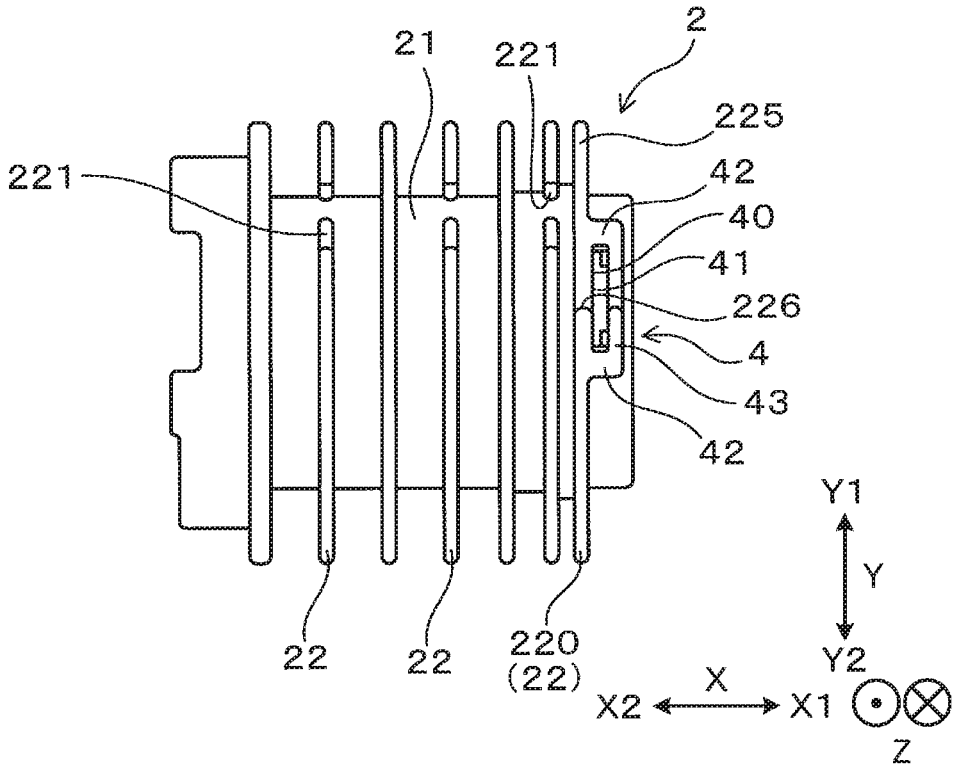
FIG. 7 is a bottom view of the second spool according to the first embodiment.

The second spool 2 is made of resin having insulating properties. As shown in FIGS. 1 and 7, the second spool 2 includes a tubular portion 21 having a tube shape and a plurality of flange parts 22 each having a circular shape and protruding outward from the outer periphery surface. The tubular portion 21 is formed in a rectangular shape in which the corner part thereof is rounded.

Figure 2:
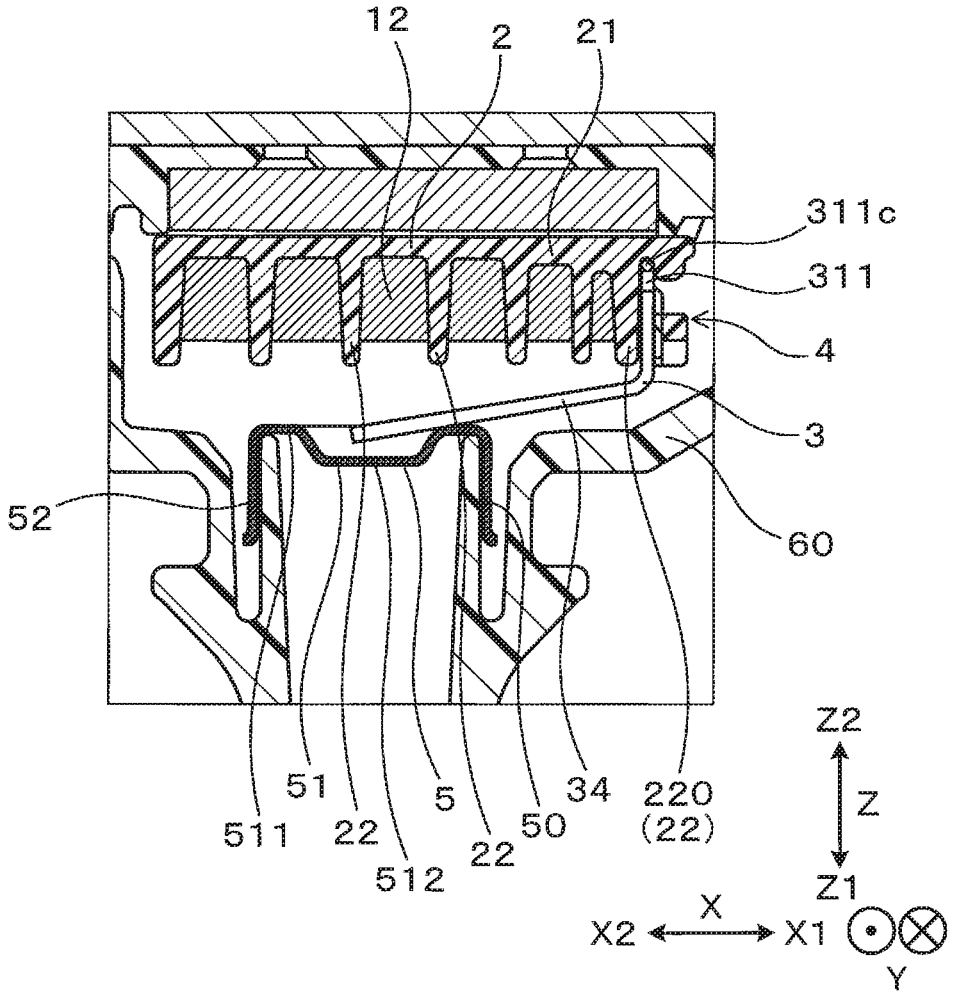
FIG. 2 is an enlarged view of a portion in the vicinity of a connection terminal in the cross-sectional diagram of the ignition coil in a state before filling the thermosetting resin according to the first embodiment.
Figure 6:
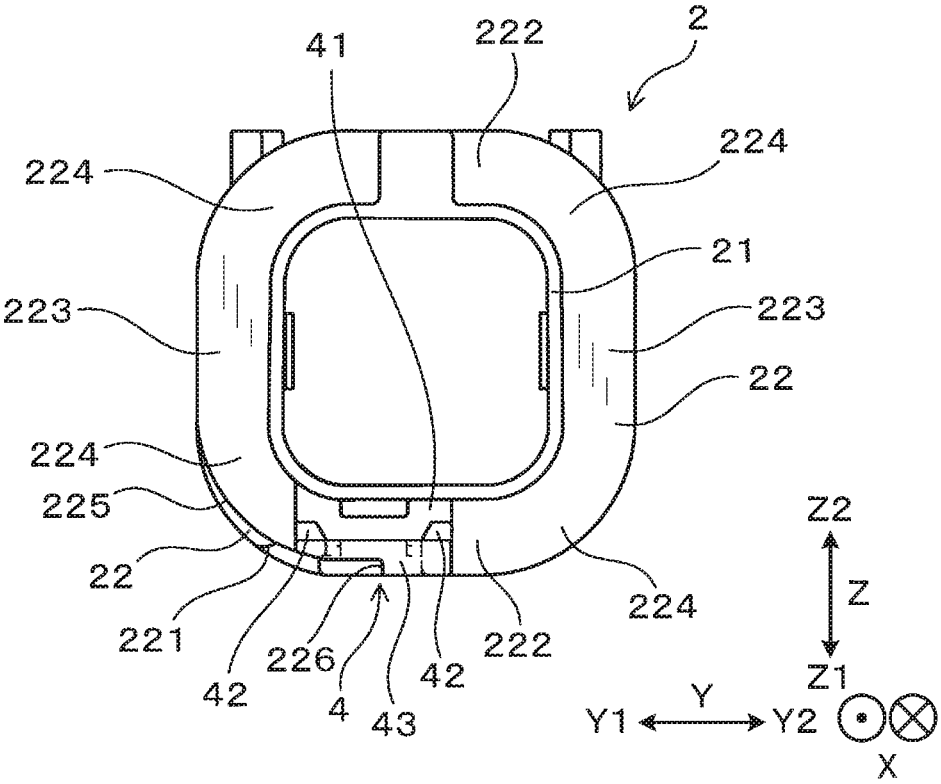
FIG. 6 is a front view of the second spool according to the first embodiment.

As shown in FIG. 6, the flange portion 22 is formed in a rectangular ring shape in which the corner part is rounded. As shown in FIG. 7, the plurality of flange portions are arranged to have predetermined intervals in the X direction. As shown in FIGS. 1 and 2, the secondary coil 12 is wound around a winding layer between adjacent flange portions 22 in the second spool 2. As shown in FIG. 7, a slit 221 is formed in each flange portion 22 to lead the secondary coil 12 from adjacent one winding layer to the other winding layer.

As shown in FIG. 6, each flange portion 22 includes a pair of lateral side portion 222, a pair of vertical side portion 223, and a round shaped portion 224 which will be described later. The pair of lateral side portion 222 are formed straight in the Y direction and being perpendicular to the Z direction. The pair of vertical side portion 223 is formed straight in the Z direction and being perpendicular to the Y direction. The round shaped portion 224 is formed in each of the four corners of the flange portion 22 to smoothly connect one end of the lateral side portion 22 and one end of the vertical side portion 223 in the coil circumferential direction.

Figure 8:
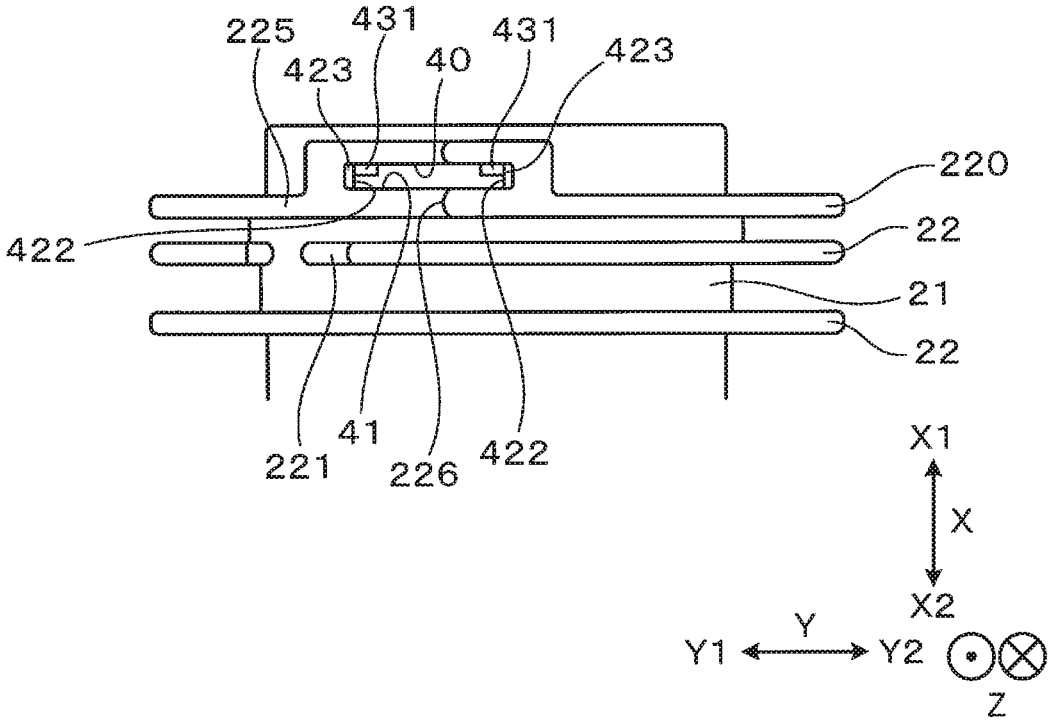
FIG. 8 is an enlarged view of a portion in the vicinity of an insertion hole portion in FIG. 7.

As shown in FIGS. 6 to 8, a front flange portion 220 is provided at an end portion in the X1 side of the flange portions 22. The front flange portion 220 includes a rear edge in 225 in which a part of outer periphery end edge is positioned backwards towards inside the coil radial direction. As shown in FIG. 6, the rear edge portion 225 is formed from a part of the lateral side portion 222 in the Z1 side to an end portion opposite to the lateral side portion of the round shaped portion 224 which is adjacent to the one side of the Y direction of the lateral side portion 222 (hereinafter referred to as Y1 side, and an opposite side relative to the Y1 side in the Y direction is referred to as Y2 side). As shown in FIG. 6, the rear edge portion 225 is configured to be positioned further backwards towards inside the coil radial direction than the position of the flange portion 22 which is adjacent to the X2 side of the front flange portion 22, when viewed from the X direction.

As shown in FIG. 6, the rear edge portion 225 is formed such that the closer towards the end portion in the lateral side portion 222 from the edge portion of the round shaped portion 224 in the coil radial direction, the larger the degree of positioning backwards towards an inner periphery side of the coil radial direction. Thus, a step portion 226 is formed in an end portion opposite to the round shaped portion 224 side of the rear edge portion 225 in the coil radial direction. Specifically, the step portion 226 is formed between the end portion opposite to the round portion 224 and the end edge of the lateral side portion 222 excluding the rear edge portion 225. On the other hand, an end portion of the rear edge portion 225 in the round shaped portion 224 side in the coil radial direction is formed continuously with the end edge of the vertical side portion 223.

Figure 3:
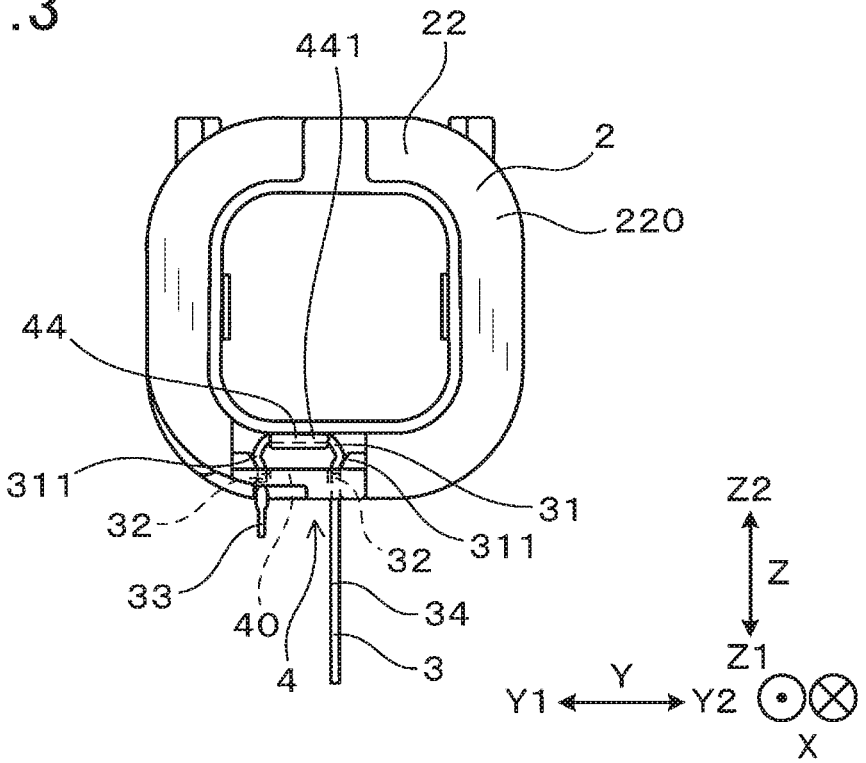
FIG. 3 is front view showing the connection terminal being mounted to the second spool in a state before bending a terminal connection portion according to the first embodiment.

For the front flange portion 220, a portion closer to an opposite portion with respect to the rear edge portion 225 than to the step portion 226 in the coil circumferential direction protrudes outwards in the coil radial direction than the rear edge portion 225. The rear edge portion 225 is formed such that the end portion of the wire of the secondary coil 12 (i.e. portion connected to the connection terminal 3) is readily withdrawn from the second spool 2. As shown in FIG. 3, the terminal support portion 4 is provided in a Z1 side of the tubular portion 21 on an X1 side surface of the front flange portion 220.

As shown in FIG. 6, the terminal support portion 4 includes a raised wall 41 which is raised towards the X1 side from the front flange portion 220, a pair of locking portions 42 protruding from both sides of the raised wall 41 in the Y direction and mutually facing in the Y direction, and a connection wall 43 that connects portions in the Z1 side at the X1 side end portion of the locking portion 42, to be in the Y direction.

As shown in FIG. 6, the raised wall 41 is formed in the entire region in the Z direction of the lateral side portion 222 of the Z1 side. Also, the raised portion 41 is formed to be larger than the maximum width of the connection terminal 3 in the Y direction. The raised wall 41 is formed at a position across the step portion 226 in the Y direction.

As shown in FIG. 6, the pair of locking portions 42 are formed at a Z1 side end portion of the raised wall 41. In the pair of locking portions 42, a locking portion 42 in the Y1 side is formed in the Z2 side of the rear edge portion 225. In the Z-direction, a locking portion 42 in the Y1 side in the pair of locking portions 42 is formed to be shorter than the locking portion 42 in the Y2 side. A first surface portion 421, a second surface portion 422 and a third surface portion 423 are provided, from Z2 side towards Z1 side, on a surface of each locking portion 42 that faces the other locking portion 42 in the Y direction.

Figure 4:
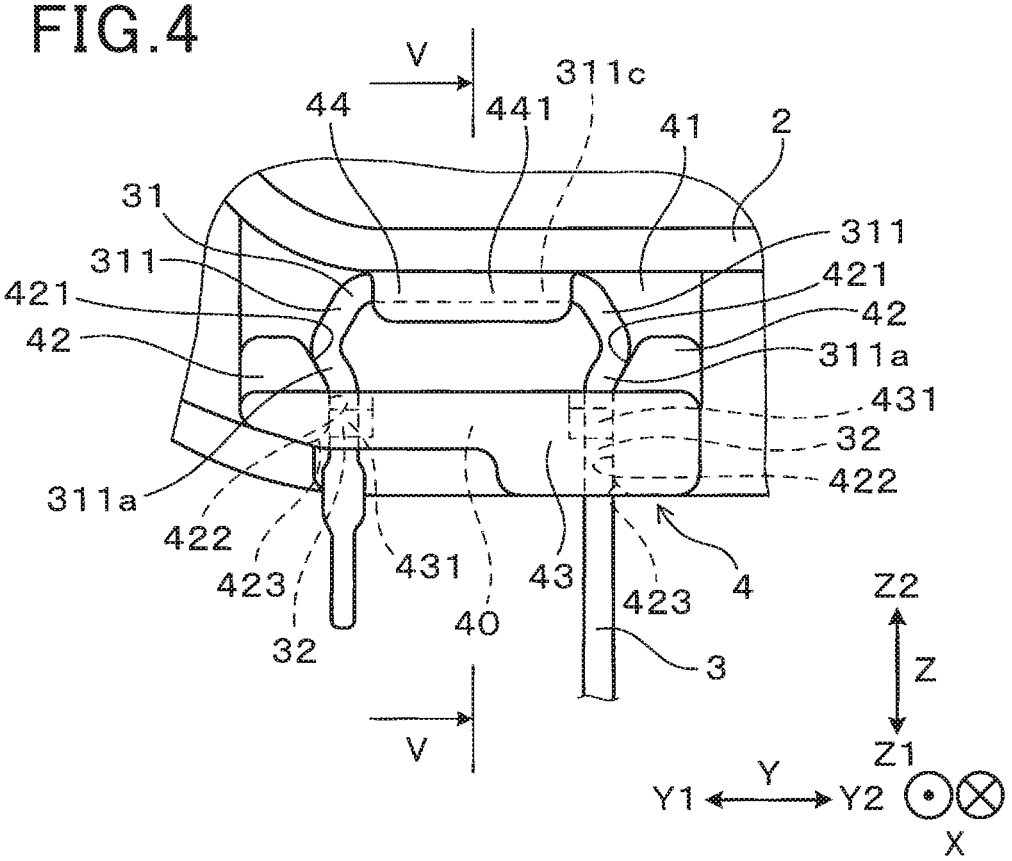
FIG. 4 is an enlarged view of a portion in the vicinity of a terminal support portion.

As shown in FIG. 4, the first surface 421 is inclined such that the closer towards the Z2 side, the more inclined outside the pair of locking portions 42 in the Y direction. The second surface portion 422 is formed straight from the Z1 side end portion to the Z2 side. The second surface portion 422 of the pair of locking portions face each in the Y direction. The second surface portion 422 of the Y1 side locking portion 42 in the pair of locking portions 42 is formed to be shorter in the Z direction than the second surface portion 422 of the other locking portion 42. The third surface portion 423 is inclined such that the closer towards the Z1 side, the more inclined outside the pair of locking portions 42 in the Y direction.

As shown in FIG. 4, the connection wall 43 connects the Z1 side end portions of the pair of locking portions 42 in the Y direction. Specifically, the connection wall 43 is connected to the Z1 side region than to the first surface 421 of the pair of locking portions 42 in the Z direction. Thus, the region where the first surface portion 421 of the locking portion 42 is formed, protrudes close to Z2 side than to the connection wall 43. In other words, the first surface portion 421 is formed at a visible position capable of being seen when viewed from the X direction. Also, when viewed from the X direction, the connection wall 43 is formed at a position across the step portion 225 of the rear edge portion 225 in the Y direction.

Figure 5:
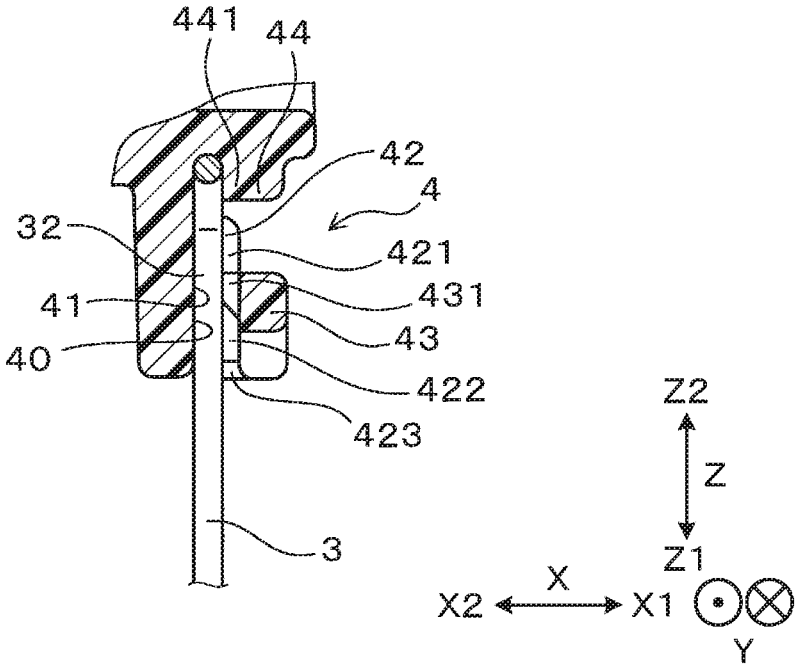
FIG. 5 is a cross-sectional view sectioned along a line V-V shown in FIG. 4.

As shown in FIGS. 4,5 and 8, the connection wall 43 includes a press-fitted convex portion 431 protruding towards the X2 side. As shown in FIG. 5, the connection terminal 3 is press-fitted between the raised wall 41 of the insertion hole portion 40 and the press-fitted convex portion 431. The press-fitted convex portion 431 is press-contacted to the connection terminal 3 such that the connection terminal 3 is pressed towards the raised wall 41 side.

As shown in FIG. 4, the press-fitted convex portion 431 is formed at a portion adjacent to inner side in the Y direction with respect to the pair of locking portions 42. The press-fitted convex portion 431 is formed at a portion adjacent to the pair of locking portion 42 in the Y direction. As shown in FIG. 5, for the side end portion of the press-fitted convex portion 431, an amount of protrusion of the side end portion to the X2 side becomes smaller towards the Z1 side. Thus, the connection terminal is readily inserted to the terminal support portion 4.

As shown in FIG. 7, the above-described insertion hole portion 40 is constituted of a part of the raised wall 41, the pair of locking portion 42 and the connection wall 43. The insertion hole portion 40 is formed in a circular shape which is opened in the both sides with respect to the Z direction. The insertion hole portion 40 is formed in a circular shape having longitudinal length in the Y direction.

Also, end edges of the raised wall 41 and the connection wall 43 are formed to be in parallel to the end edge in the Z1 side of the front flange portion 220. Thus, a step shaped portion is formed at the raised wall 41 and the connection wall 43 as similar to the step portion 225 of the front flange portion 226.

As shown in FIGS. 3 to 5, the second spool 2 includes a support portion 44 at the insertion hole portion 40 in the Z2 side. The support portion supports the connection terminal 3 in the X direction. In other words, the support portion 44 supports an inner periphery exposed portion 31 in the X direction.

The support portion 44 supports, with a part of the raised wall 31 in the terminal support portion 4 and an opposed wall 441 extended from the flange portion 22 towards Z1 side, a terminal end portion 311*c* which will be described later in the X direction. That is, the support portion 44 is constituted by a part of the raised wall 41 and the opposed wall 441. The opposed wall 441 is formed having longitudinal length in the Y direction and opposing the raised wall 41 in the X direction. As shown in FIG. 5, space inside the support portion 44 is provided at a portion overlapping the inside space of the insertion hole portion 40 of the terminal support portion 4 in the Z direction.

Figure 9:
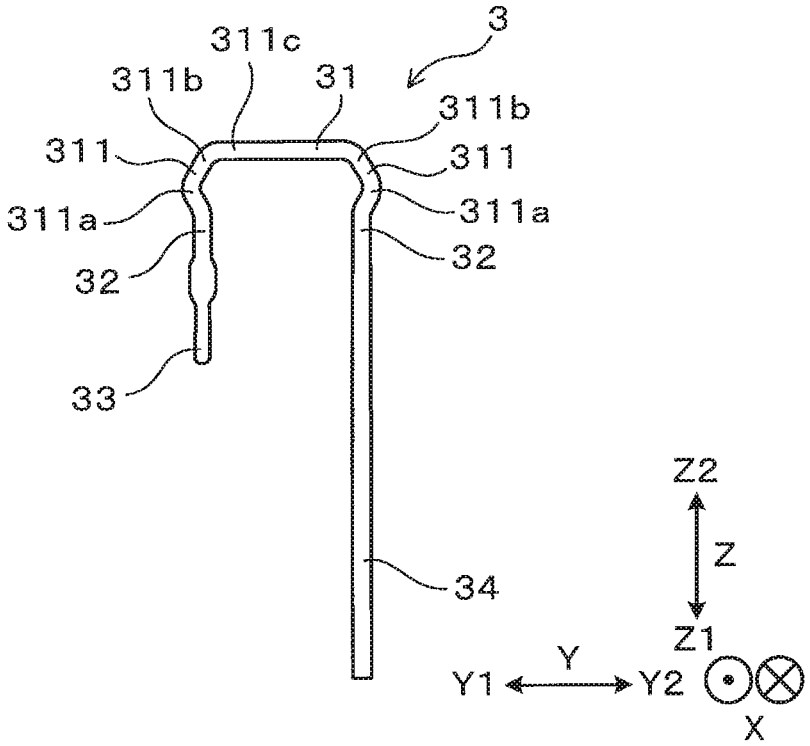
FIG. 9 is a front view of a connection portion according to the first embodiment.

As shown in FIGS. 3 and 9, the connection terminal 3 is constituted such that a metal wire material capable of being elastic deformed is bent in a U shape being opened outward in the coil radial direction. The width direction of the connection terminal 3 is defined as the Y direction. The connection terminal 3 includes an insertion portion 32, an inner periphery exposed portion 31, the inner periphery exposed portion 31, a coil connection portion 33 and a terminal connection portion 34.

The insertion portion 32 is inserted into the insertion hole portion 40 of the connection terminal 3. As shown in FIG. 9, a pair of insertion portions 32 is arranged in the Y direction to be extended in the Z direction. As shown in FIG. 5, each insertion portion 32 is press-fitted between the raised wall 41 and the press-fitted convex portion 431 in the X direction.

As shown in FIG. 4, each insertion portion 32 is disposed on a surface of the second surface portion 422 of the locking portion 42. In a state where the connection terminal 3 is not elastic-deformed, the dimension of the pair of insertion portions 32 in the Y direction is set to be larger than the dimension of the pair of second surface portions 422 in the Y direction. Thus, the pair of insertion portions 32 applies its elastic force (i.e. restoring force) to the second surface portion 422 in a state where the connection terminal 3 is assembled to the terminal support portion 4.

The inner periphery exposed portion 31 is formed in a Z2 side with respect to the insertion portion 32, and exposed to the Z2 side from the insertion hole portion 40. The coil connection portion 33 is formed extending from the Y1 side of the insertion portion 32 towards Z1 side. Although illustration is omitted, a high voltage side end portion of the secondary coil 12 is connected to the coil connection portion 33. As shown in FIG. 2, the terminal connection portion 34 is formed extending from the insertion portion 32 in the Y2 side towards the Z1 side, and connected to the high voltage output terminal 5. As shown in FIG. 9, the terminal connection portion 34 is formed to be longer than the coil connection portion 33.

As shown in FIG. 9, the inner periphery exposed portion 31 is formed such that end portion in the Z2 side of the pair of insertion portion 32 are connected to each other by being folded. Both ends of the inner periphery exposed portion 31 in the Y direction includes the above-described protrusion 311 protruding outside the connection terminal 3 in the Y direction. In other words, according to the present embodiment, the inner periphery exposed portion 31 includes the protrusions 311 at both ends thereof.

As shown in FIG. 4, a region where the protrusion 311 in the inner periphery exposed portion 31 in the Z direction is formed is longer than the minimum length of the internal space of the insertion hole portion 40 in the Y direction (according to the present embodiment, length between the pair of second surface portion 422 in the Y direction). Thus, the connection terminal 3 is hooked at the inversion hole portion in the protrusion 311.

As shown in FIGS. 4 and 9, an outer inclination portion 311*a* is formed at a portion in the Z1 side of the protrusion 311. The outer inclination portion 311*a* is inclined such that the closer towards the Z2 side, the more inclined outside the connection terminal 3 in the Y direction. The outer inclination portion 311*a* is formed by each of the pair of insertion portions 32. The terminal support portion 4 faces the outer inclination portion 311*a* and locks the connection terminal 3. According to the present embodiment, the first surface portion 421 of the pair of locking portions 42 in the terminal support portion 4 is formed to be in parallel to the adjacent outer inclination portion 311*a*, and supports the outer inclination portion 311*a*.

As shown in FIGS. 4 and 9, an inner inclination portion 311*b* is formed at a portion in the Z2 side of the protrusion 311. The inner inclination portion 311*b* is inclined such that the closer towards the center of the connection portion 3 in the Y direction, the more inclined towards the Z2 side. According to the present embodiment, the inner inclination portion 311*b* is formed by respective Z2 side end portions of the pair of outer inclination portion 311*a*.

The inner inclination portion 311*b* is formed at a portion overlapping the Z1 side end portion of the inner surface of the insertion hole portion 40 in the Z direction. According to the present embodiment, the inner inclination portion 311*b* is formed at a portion overlapping the third surface portion 423 of the pair of locking portions 42 in the Z direction. The inner inclination portion 311*b* constitutes the surface of the connection terminal 3 when viewed from the Z2 side. In other words, the inner inclination portion 311*b* is formed to be seen when the connection terminal 3 is viewed from the Z2 side. The inner inclination portion 311*b* serves as a guide portion when the connection terminal 3 is inserted into the insertion hole portion 40. The connection terminal 3 is inserted into the insertion hole portion 40 while the inner inclination portion 311*b* is in contact with the pair of locking portions 42 of the insertion hole portion 40.

As shown in FIG. 9, the terminal end portion 311*c* is formed at the Z2 side end portion of the inner exposed portion 31. The terminal end portion 311*c* couples the Z2 side end portions of the pair of protrusions 311. According to the present embodiment, the terminal end portion 311*c* is formed to be straight in the Y direction. As shown in FIG. 4, the length of the terminal end portion 311*c* in the Y direction is formed to be substantially the same as the length of the opposed wall 441 of the support portion 44 or slightly longer than the length of the opposed wall 441. The terminal end portion 311*c* is inserted into a concave portion surrounded by the support portion 44 and the tubular portion 21, and supported by the support portion 44.

As shown in FIG. 9, a part of the coil connection portion 33 is formed to be wider than those of other portions of the coil connection portion 33. Thus, a lead wire that constitutes the secondary coil 12 can readily be connected to the coil connection portion 33. Although illustration is omitted, the lead wire that constitutes the secondary coil 12 is connected to the coil connection portion 22 by a micro arc welding or the like.

As shown in FIG. 2, after assembling the ignition coil 1, for the terminal connection portion 34, a portion opposite to the insertion portion 32 is elastic deformed towards X2 side. The end portion in the opposite side of the insertion portion 32 of the terminal connection portion 34 is press fitted to the high voltage output terminal 5 by elastic restoring force.

As shown in FIG. 2, the high voltage output terminal 5 shows a cup shape opened in the Z1 direction. The high voltage output terminal 5 includes a bottom wall portion having a substantial disk shape, and a side wall portion 52 extended in the X1 side from the periphery edge of the bottom wall portion 51. The bottom wall portion 51 includes a circular portion 511 formed at the outer periphery portion thereof, and a bottom up portion 512 formed at the center of the circular portion 511 and protruded towards the tip end side from the circular portion 511. Then, the terminal connection portion 34 of the connection terminal 3 is elastically contacted with the circular portion 511 of the high voltage terminal 5.

As shown in FIG. 1, the high voltage output terminal 5 is engaged with a high voltage tower 71 of a casing 60 that accommodates components constituting the ignition coil 1. The high voltage tower 71 is formed such that a part of the casing 60 protrudes towards the Z1 side and has a tube shape. The high voltage output terminal 5 closes the inner space of the high voltage tower 61 from the Z2 side. The ignition coil 1 is constituted to output the high voltage of the secondary coil 12 from the high voltage output terminal 12.

As shown in FIG. 1, the casing 60 includes thermosetting resin 14 filled therein for sealing components constituting the ignition coil 1. The high voltage output terminal 5 also serves as a plug used to avoid leaking of the thermosetting resin in the casing 60 from the high voltage tower 60. Note that FIG. 2 illustrates a state before the thermosetting resin is filled into the casing 60.

As shown in FIG. 1, a center core 15 is disposed in the inner periphery side of the first spool 13 such that the longitudinal direction thereof corresponds to the X direction. For the first spool 13, the center core 15 is disposed inside the molding frame and insert-molded. An outer periphery core 16 is arranged to surround the outer periphery of the primary coil 11 and the secondary coil 12. The center core 15 and the outer periphery core 16 constitute the magnetic path of the magnetic flux produced by conduction and cutting off of the primary coil 11.

A magnet 17 is provided between the center core 15 and the outer periphery core 16. An igniter 18 is provided in the X2 side of the outer periphery core 16 to conduct/cutoff the primary coil 11. The casing 60 is provided with a connector 62 protruding the X2 side. The connector 62 is constituted to engage with portions other than the connector 62 of the casing 60. That is, the connector 62 is formed separately together with portions other than the connector 62. The connector 62 is provided being integrated with the first spool 13.

Figure 10:
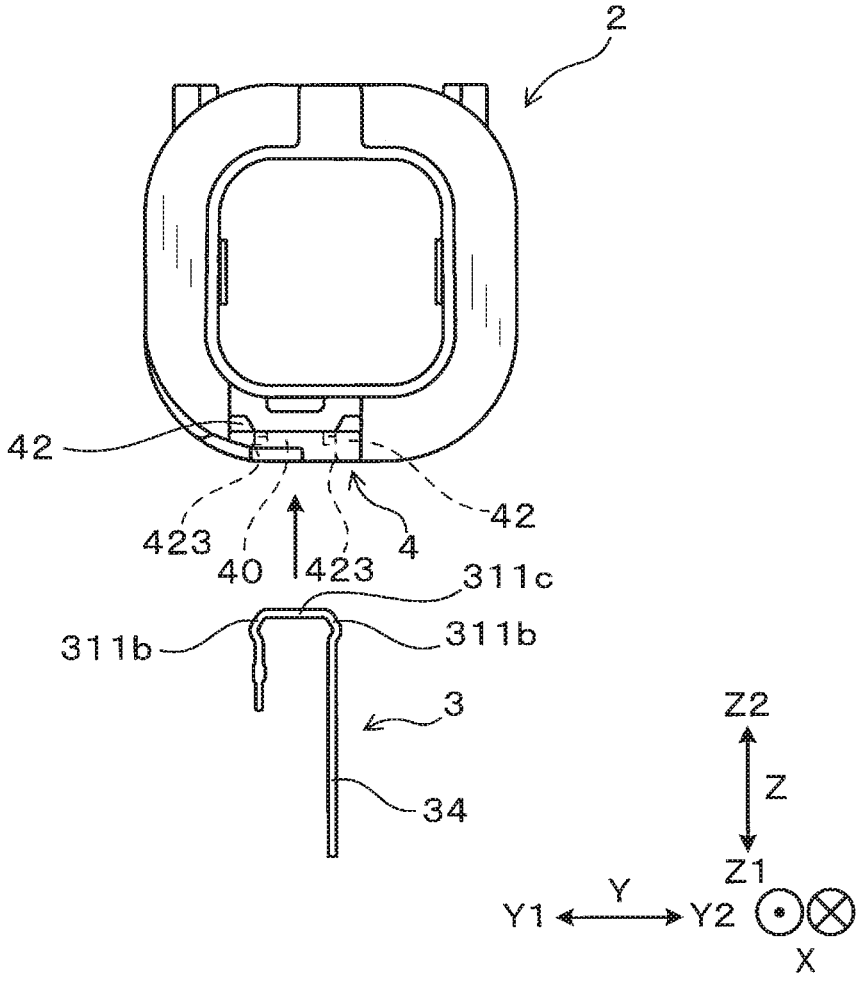
FIG. 10 is a front view of the connection terminal being mounted to the second spool in a state before bending the second spool and the terminal connection portion according to the first embodiment.

Next, with reference to FIGS. 10 and 11, a method for assembling the connection terminal 3 and the secondary coil 12 with the second spool 2 will be described.

First, the connection terminal 3 is mounted to the second spool 2. At this time, as shown in FIG. 10, the connection terminal 3, in which the terminal connection portion 34 formed straight without being bent, is inserted into the insertion hole portion 40 of the terminal support portion 4. First, a pair of inner inclination portions 311*b* of the connection portion 3 come into contact with the third surface portion 423 of the pair of locking portion 42. With this state, the connection terminal 3 is pressed inward the insertion hole portion 40. Thus, a compression force is applied by the pair of locking portion 42 to the connection terminal 3 inwardly in the Y direction, thereby inserting the insertion hole portion 40 while being compressed in the Y direction.

Then, when the region where the protrusion 311 of the connection portion 3 is formed passes through a portion between the second surface portions 422 of the pair of locking portions 42, and the inner periphery exposed portion 31 is disposed in the Z2 side of the insertion hole portion 40, the connection terminal 3 is expanded in the Y direction because of the restoring force. Thus, the insertion portion 32 of the connection terminal 3 is press-fitted to the second surface portion 422 of the pair of locking portions 42 and is pressed-in to a portion between the raised wall 41 and the press-fitted convex portion 431. Further, the pair of outer inclination portions 311*a* of the connection terminal 3 are arranged along the first surface portion 421 of the pair of locking portions 42, and locked by the first surface portion 421 of the pair of locking portions 42. Also, the terminal end portion 311*c* of the inner exposed portion 31 is inserted into the support portion 44 formed at the Z2 side of the insertion hole portion 40. As described, the connection terminal 3 is supported by the terminal support portion 4.

Figure 11:
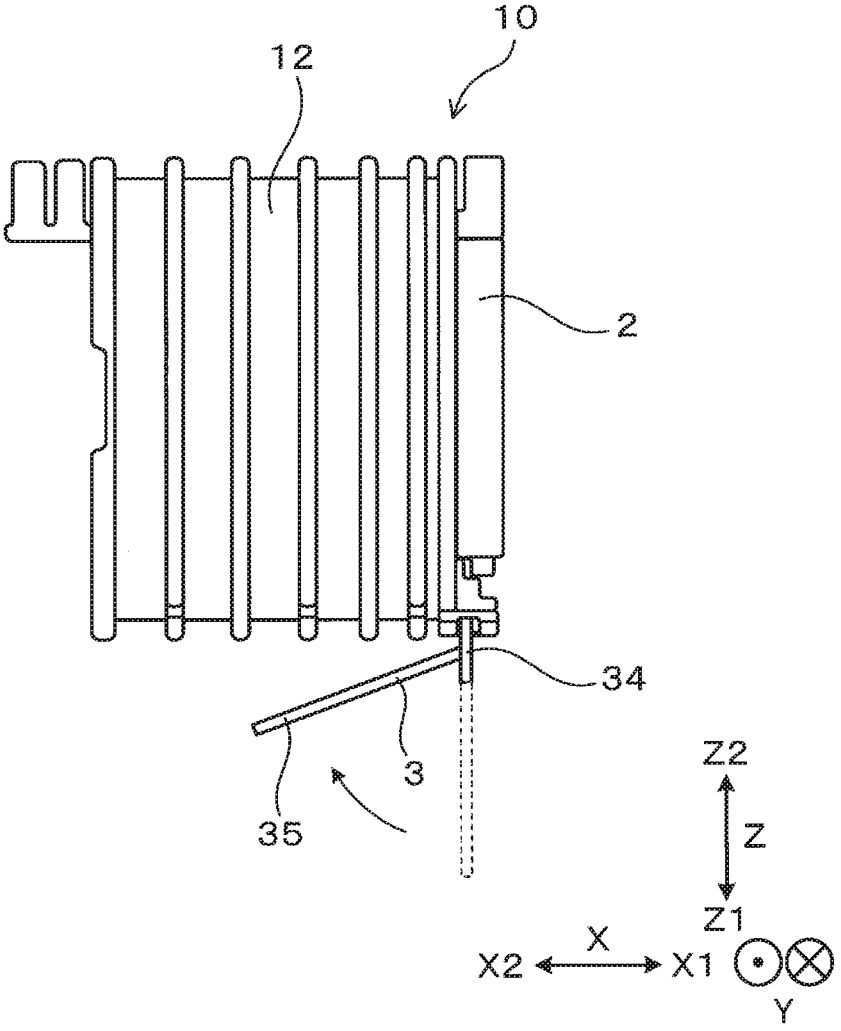
FIG. 11 is a side view of the second spool and the connection terminal showing a state where the terminal connection portion of the connection terminal is bent according to the first embodiment.

Next, as shown in FIG. 11, a lead wire that constitutes the secondary coil 12 is wound around the second spool 2. At this time, although illustration is omitted, after fixing an initial winding portion of the lead wire of the secondary coil 12 to a predetermined portion of the second spool 2, the second spool 2 is rotated at high speed, whereby the lead wire is wound around the second spool 2. The rotational speed of the second spool 2 when the secondary coil is wounded is preferably 20000 rpm or more for example, considering reduction of required time for winding the lead wire. When considering a further reduction of the required time for winding the lead wire, the rotational speed of the second spool 2 is more preferably 30000 rpm or more.

Then, after winding the secondary coil 12 on the second spool 2, an end winding portion of the secondary coil 12 is connected to the coil connection terminal 33 of the connection terminal 3. Then, as shown in FIG. 11, the terminal connection portion 34 of the connection terminal 3 is bent such that the tip end portion thereof extends towards X1 side. The bend angle of the connection terminal 3 (i.e. an angle formed between the connection terminal 3 before being bent and the connection terminal 3 after being bent) is smaller than a bend angle of the terminal connection portion 34 when the ignition coil 1 is completed to be assembled.

Thus, the connection terminal 3 and the secondary coil 12 are mounted to the second spool 2. Note that the above-described assembly composed of second spool 2, the secondary coil 12 and the connection terminal 3 is referred to as a coil assembly 10.

Next, a method for connecting the connection terminal 3 and the high voltage terminal 5 mounted to the second spool 2 will be described.

The high voltage output terminal 5 is attached to the high voltage tower 61 in the casing 60. Then, the coil assembly 10 is inserted into the casing 60 in the Z direction, whereby the terminal connection portion 34 of the connection terminal 3 comes into contact with the high voltage output terminal 5. Then, the coil assembly 10 is further inserted into the casing 60, and arranged at a predetermined position (final position) in the casing 60. Thus, the high voltage output terminal 5 is elastically contacted to the connection terminal 3 by the restoring force. As described, the connection terminal 3 and the high voltage out output terminal 5 are connected.

Next, effects and advantages obtained from the present embodiment will be described. According to the ignition coil 1 of the internal combustion engine, the connection terminal 3 includes the protrusion 311 that protrudes outside the connection terminal 3 in the Y direction. The protrusion 311 is locked at the terminal support portion 4 in the Z direction. Therefore, the connection terminal 3 is locked at the terminal support portion 4 in the Z direction and is difficult to detach from the terminal support portion 4.

Also, the connection terminal 3 is formed by bending a metal wire material capable of being elastically deformed, in a U shape opened towards outside in the coil radial direction. Hence, the connection terminal can readily be compressed when inserting the connection terminal 3 into the insertion hole 40. Further, since the connection terminal 3 is constituted by bending the wire material, the connection terminal 3 can readily be formed. Also, the manufacturing yield when manufacturing the connection terminal 2 can be high.

The inner inclination portion 311*b* is formed at the inner end portion in the coil radial direction in the protrusion 311. Hence, when inserting the connection terminal 3 into the insertion hole portion 40, the inner inclination portion 311*b* of the connection terminal 3 comes into contact with the insertion hole portion 40. Then, the connection terminal 3 is pressed into the insertion hole portion 40, whereby the inner exposed portion 31 of the connection terminal 3 is compressed in the Y direction and passes through the insertion hole portion 40. Therefore, the connection terminal 3 can readily be inserted into the insertion hole portion 40.

Also, the outer inclination portion 311*a* is formed at the Z1 side end portion in the protrusion 311. The terminal support portion 4 faces the outer inclination portion 311*a* to lock the connection terminal 3. Hence, the connection terminal 3 is stably supported by the terminal support portion 4, and is likely to be prevented from being inclined from a predetermined position with respect to the terminal support portion 4.

Also, the connection terminal 3 is press-fitted into the insertion hole portion 40. Hence, the connection terminal 3 is more stably supported by the terminal support portion 4.

Also, the terminal support portion 4 includes the support portion 44 that supports the connection terminal 3 at a portion in the Z2 side in the insertion hole portion 40. Accordingly, as shown FIG. 11, when the terminal connection portion 34 of the connection terminal 3 is bent, the connection terminal 3 is prevented from being rotated with respect to the insertion hole 40 as the fulcrum. Further, since the number of portions in the terminal support portion 4, where the connection terminal 3 is supported, can be increased, the terminal support portion 4 more stably supports the connection portion 3.

The insertion hole portion 40 is formed in a circular shape which is opened in the both sides with respect to the Z direction. Hence, in the case where the connection terminal 3 is inserted into the insertion hole 40, the inner periphery surface of the insertion hole portion 40 interferes with the connection terminal 3, whereby the connection terminal 3 is prevented from being inclined from a predetermined position. Moreover, the protrusion 311 is formed in the inner periphery exposed portion exposed towards the Z2 side from the insertion hole portion, whereby a state of the protrusion being locked by the insertion hole 40 can be confirmed when viewed in the X direction.

As described, according to the present embodiment, an ignition coil of the internal combustion engine can be provided where the connection terminal is unlikely to detach from the second spool.

Second Embodiment

In the second embodiment, as shown in FIGS. 12 to 15, a shape of the connection terminal 3 is changed compared to that of the first embodiment.

Figure 12:
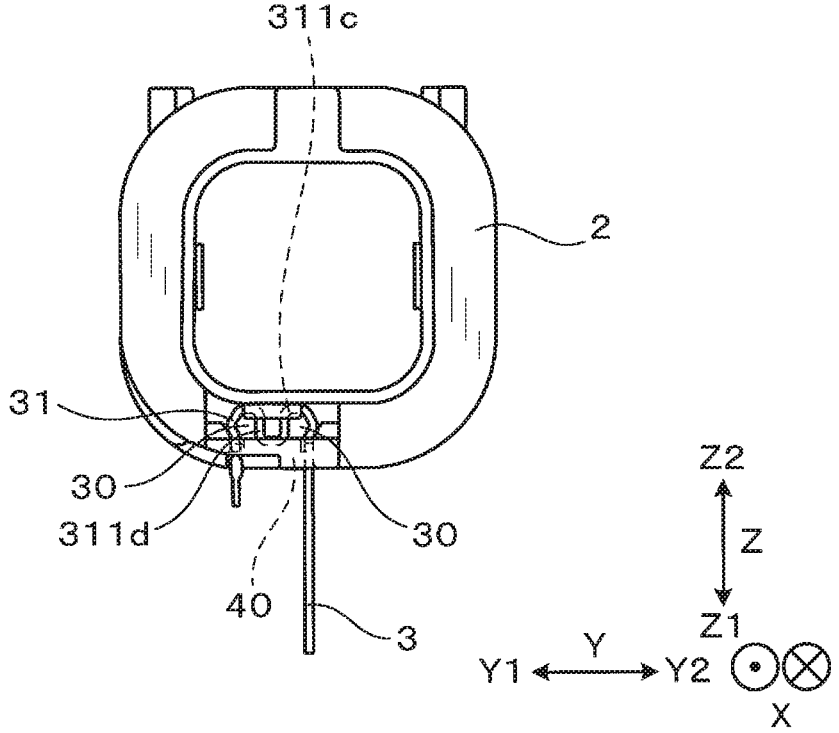
FIG. 12 is front view showing the connection terminal being mounted to the second spool in a state before bending the terminal connection portion according to a second embodiment.
Figure 13:
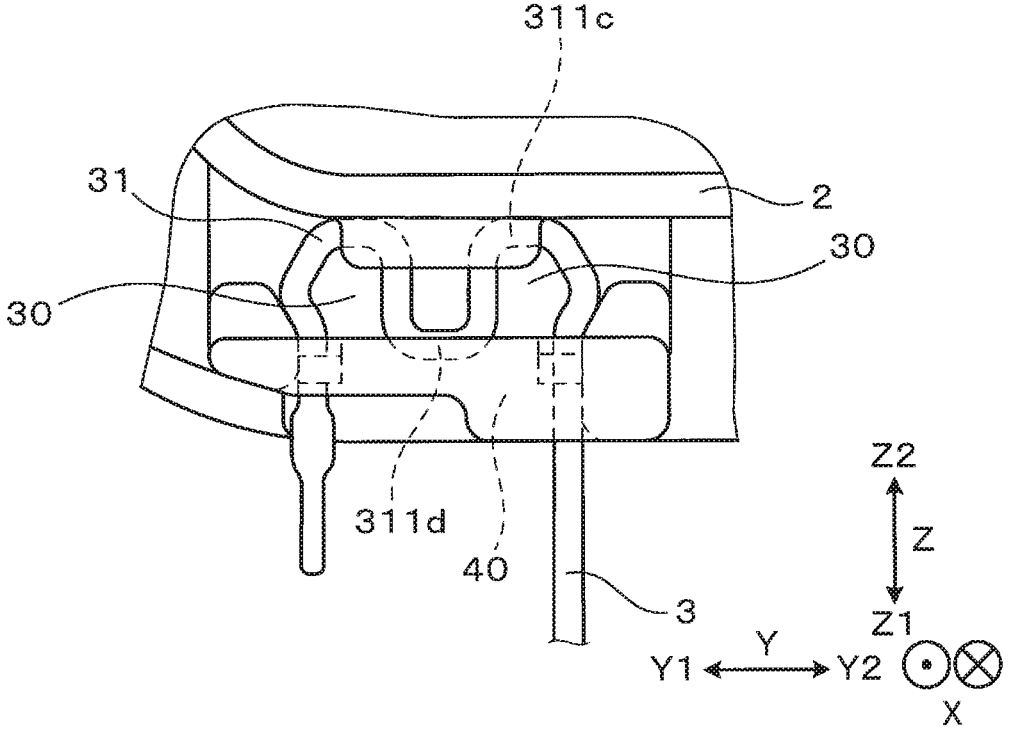
FIG. 13 is an enlarged view of a portion in the vicinity of the terminal support portion.
Figure 14:
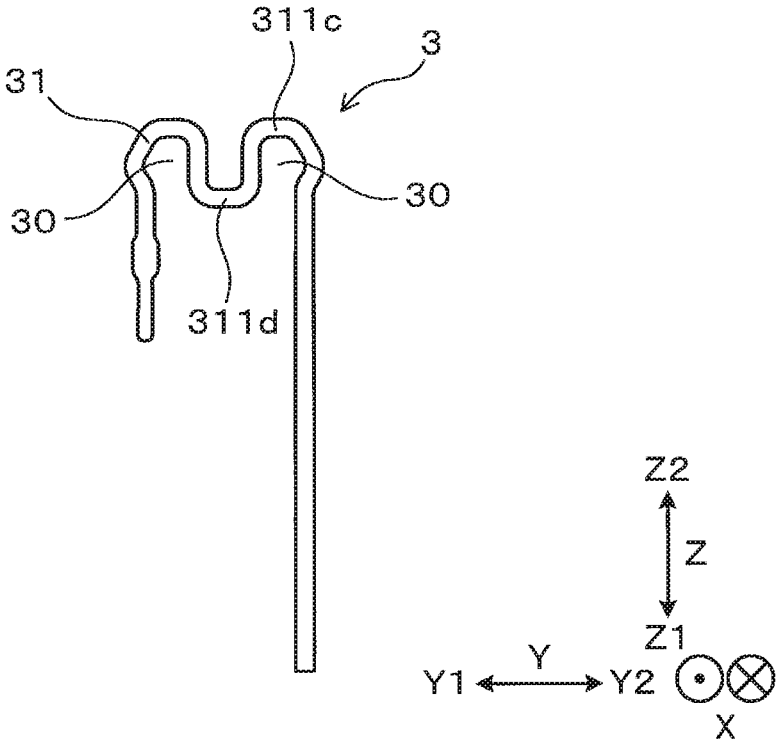
FIG. 14 is a front view of the connection terminal according to the second embodiment.

As shown in FIGS. 12 to 14, the end portion of the Z2 side of the connection terminal 3 includes a bending portion 311*d* which is bent protruding the Z1 side. The bending portion 311*d* is formed in the terminal end portion 311*c*. The bending portion 311*d* is formed such that the center portion of the terminal end portion 311*c* in the Y direction protrudes to the Z1 side rather than portions therearound. As shown in FIGS. 12 and 13, the Z1 side end portion in the bending portion 311*d* is provided in the insertion hole portion 40. The bending portion 311*d* shows a U-shape opened to the Z2 side.

As shown in FIGS. 12 to 14, in the connection terminal 3, a space 30 is formed in the both outsides of the bending portion 311*d* in the Y direction. A portion of the connection terminal 3 in the Z2 side is formed as a substantial M shape.

Figure 15:
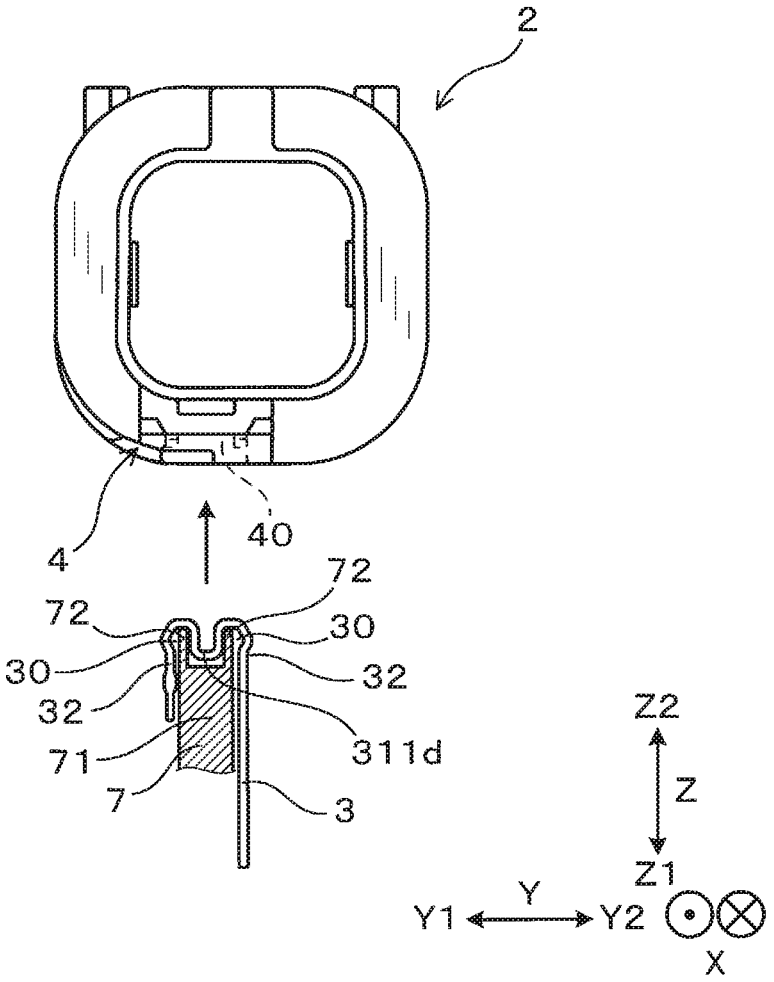
FIG. 15 is a front view of the second spool in a state where the connection terminal is being mounted to the second spool, the connection terminal in a state before bending the terminal connection portion, and a jig according to the second embodiment.
Figure 16:
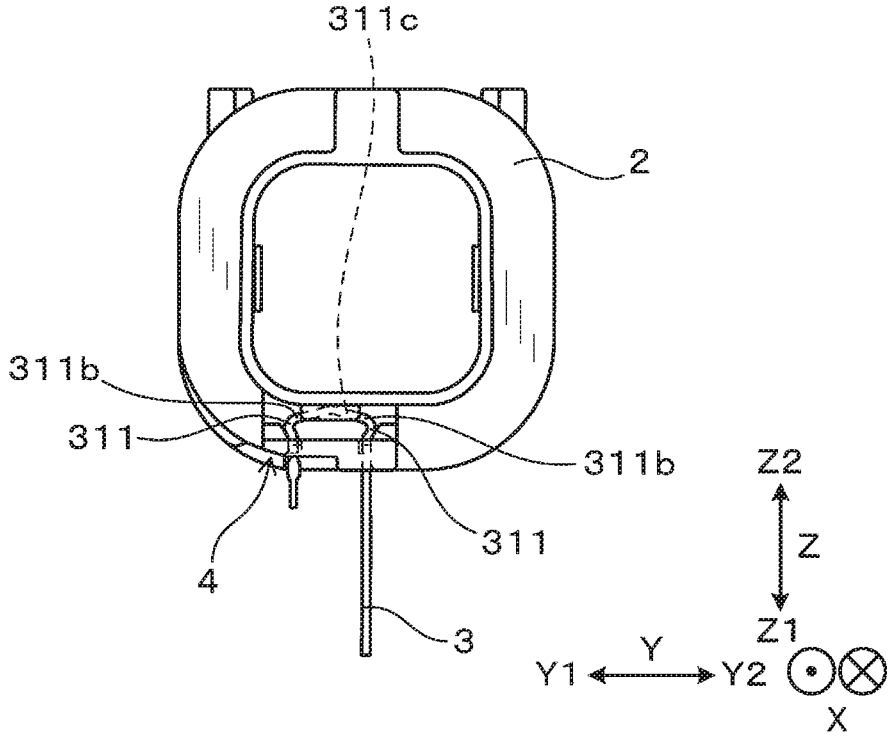
FIG. 16 is a front view showing a state where the connection terminal before bending the terminal connection terminal is mounted to the second spool according to the third embodiment.
Figure 17:
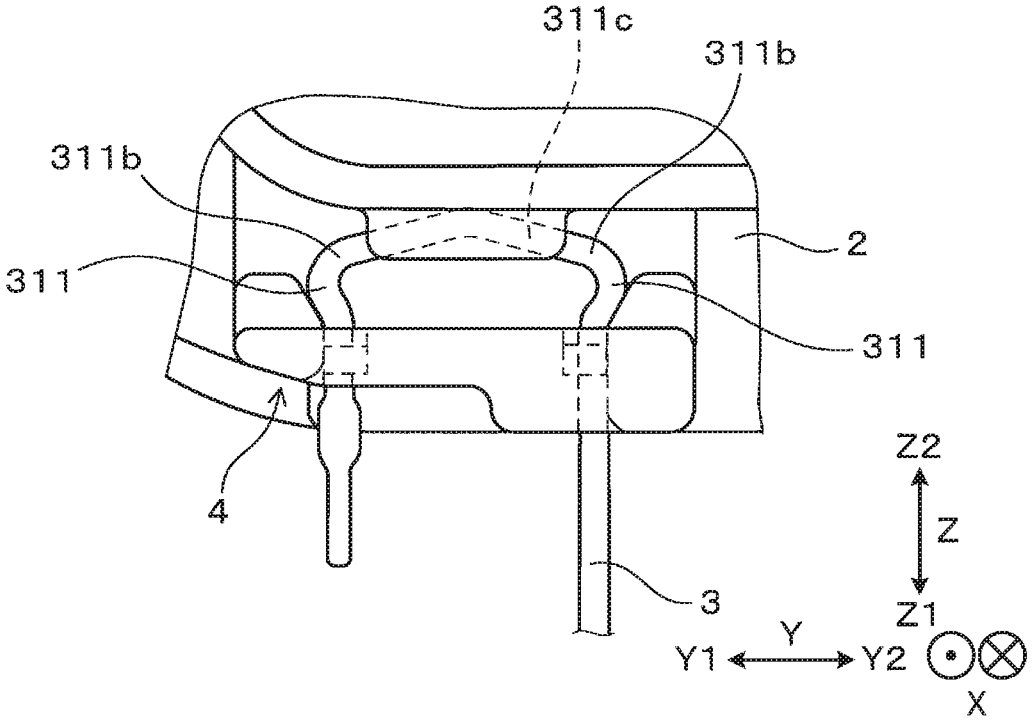
FIG. 17 is an enlarged view of a portion in the vicinity of the terminal support portion shown in FIG. 16.
Figure 18:
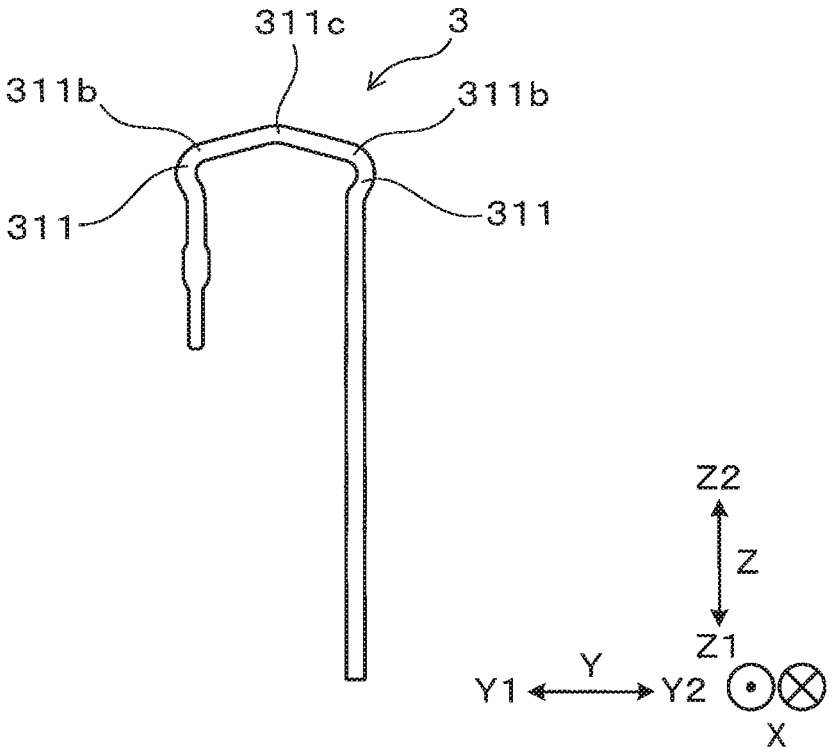
FIG. 18 is a front view of the connection terminal according to the third embodiment.

As shown in FIG. 15, when mounting the connection terminal 3 on the second spool 3, a jig 7 is used to support the connection terminal 3. In FIG. 15, for the sake of convenience, hatching is applied to the jig 7. The jig 7 includes a jig body 71 formed in a rectangular plate shape and a pair of jig protrusions 72 extended from the both ends in the Y direction of the Z2 side end portion of the jig body 71 towards the Z2 side. The jig 7 shows an U shape opened in the Z2 side at the Z2 side end portion. The dimension of the jig 7 in the Y direction is shorter than the length between the insertion portions 32 of the connection terminal 3 in a state where the jig 7 is attached to the terminal support portion 4 of the second spool 2.

According to the present embodiment, for mounting the connection terminal 3 to the terminal support portion 4 of the second spool 2, the connection terminal 3 is inserted into the insertion hole portion 40 in a state where the jig 7 supports the connection terminal 3, thereby mounting the connection terminal 3 to the terminal support portion 4, and then, the jig 7 is removed. When the connection terminal 3 is supported by the jig 7, the bending portion 311*d* is inserted to a concave portion between the pair of jig protrusions 72, and each of the jig protrusions 72 are arranged in the space 30 formed in the both outsides of the bending portion 311*d* in the Y direction of the connection terminal 3. Thus, the connection terminal 3 is supported by the jig 7. In a state where the jig 7 supports the connection terminal 3, a gap is formed between the outside portions of the pair of jig protrusions 72 in the Y direction and the connection terminal 3. Thus, the connection terminal 3 can be shortened in the Y direction when inserting the connection terminal 3 into the insertion hole portion 40.

Other portions are the same as those in the first embodiment. Note that reference numbers used after the second embodiment which are the same as those used in the aforementioned embodiments, represent similar constituents or the like to those described in the aforementioned embodiments unless otherwise specified.

According to the present embodiment, the Z2 side end portion of the connection terminal 3 includes the bending portion 311*d* which is bent protruding in the Z1 side. The connection terminal 3 includes the space 30 formed in the both sides of the bending portion 311*d* in the Y direction. Hence, when inserting the connection terminal 3 into the insertion hole portion 40, the connection terminal 3 can readily be engaged with the jig 7. Thus, the connection terminal 3 is readily prevented from being inclined with respect to the jig 7, when inserting the connection terminal 3 into the insertion hole portion 40. Hence, the connection terminal 3 can readily be inserted into the insertion hole 40. Moreover, similar effects and advantages to that of the first embodiment can be obtained.

Third Embodiment

As shown in FIGS. 16 to 19, according to the third embodiment, shapes of the connection terminal 3 and the jig 7 are modified compared to the second embodiment.

As shown in FIGS. 16 to 19, the terminal end portion 311*c* that couples the Z2 side end portions of the pair of protrusions 311 in the connection terminal 3 is formed such that the closer to the center in the Y direction, the closer to the Z2 side. Both end portions of the terminal end portion 311*c* in the Y direction are connected to the inner inclined portion 311*b* in the protrusion 311.

Figure 19:
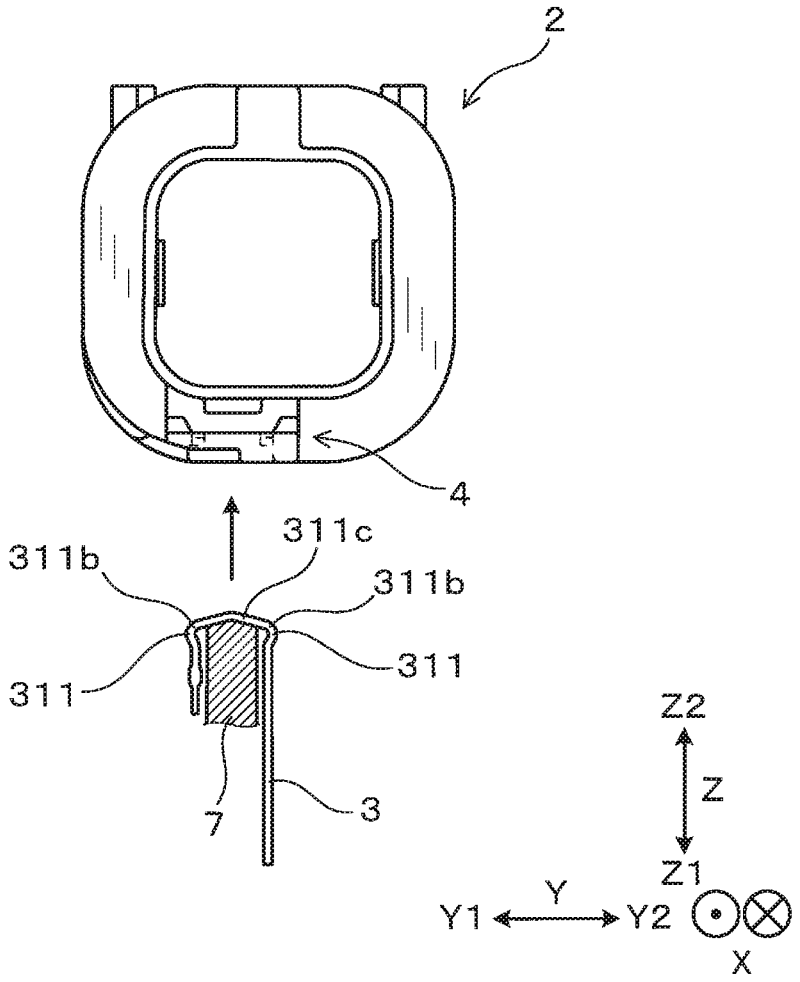
FIG. 19 is a front view is a front view of the second spool in a state where the connection terminal is being mounted to the second spool, the connection terminal in a state before bending the terminal connection portion, and a jig according to the third embodiment.

As shown in FIG. 19, according to the present embodiment, when mounting the connection terminal 3 to the second spool 2, the jig 7 is used to support the connection terminal 3. The jig is formed in a substantial rectangular plate shape. The end portion in the Z2 side of the jig 7 is formed such that the closer to the center in the Y direction, the closer to the Z2 side. In other words, the end portion in the Z2 side of the jig 7 has a shape along the terminal end portion 311*c* of the connection terminal 3.

Similar to the second embodiment, in the present embodiment, for mounting the connection terminal 3 to the terminal support portion 4 of the second spool 2, the connection terminal 3 is inserted into the insertion hole portion 40 in a state where the jig 7 supports the connection terminal 3, thereby mounting the connection terminal 3 to the terminal support portion 4, and then, the jig 7 is removed. When the connection terminal 3 is supported by the jig 7, the end portion in the Z2 side of the jig 7 is engaged with the Z1 side of the terminal end portion 311*c*. Thus, the connection terminal 3 is supported by the jig 7. Other portions are similar to those of the second embodiment.

According to the present embodiment, when inserting the connection terminal 3 into the insertion hole portion 40, the connection terminal 3 can readily be engaged with the jig 7. Further, the connection terminal 3 is readily prevented from being inclined with respect to the jig 7, when inserting the connection terminal 3 into the insertion hole portion 40. Hence, the connection terminal 3 can readily be inserted into the insertion hole 40. Moreover, similar effects and advantages to that of the first embodiment can be obtained.

Fourth Embodiment

As shown in FIGS. 20 to 23, according to the fourth embodiment, the connection terminal 3 and the terminal support portion 4 are modified compared to the first embodiment.

Figure 20:
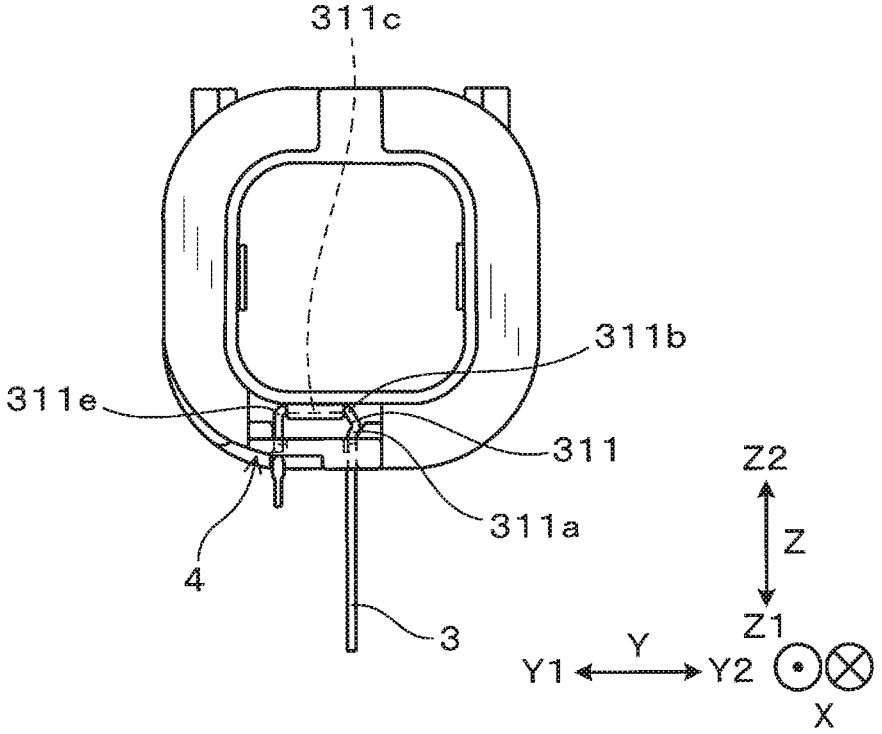
FIG. 20 is a front view showing a state where the connection terminal before bending the terminal connection terminal is mounted to the second spool according to a fourth embodiment.
Figure 21:
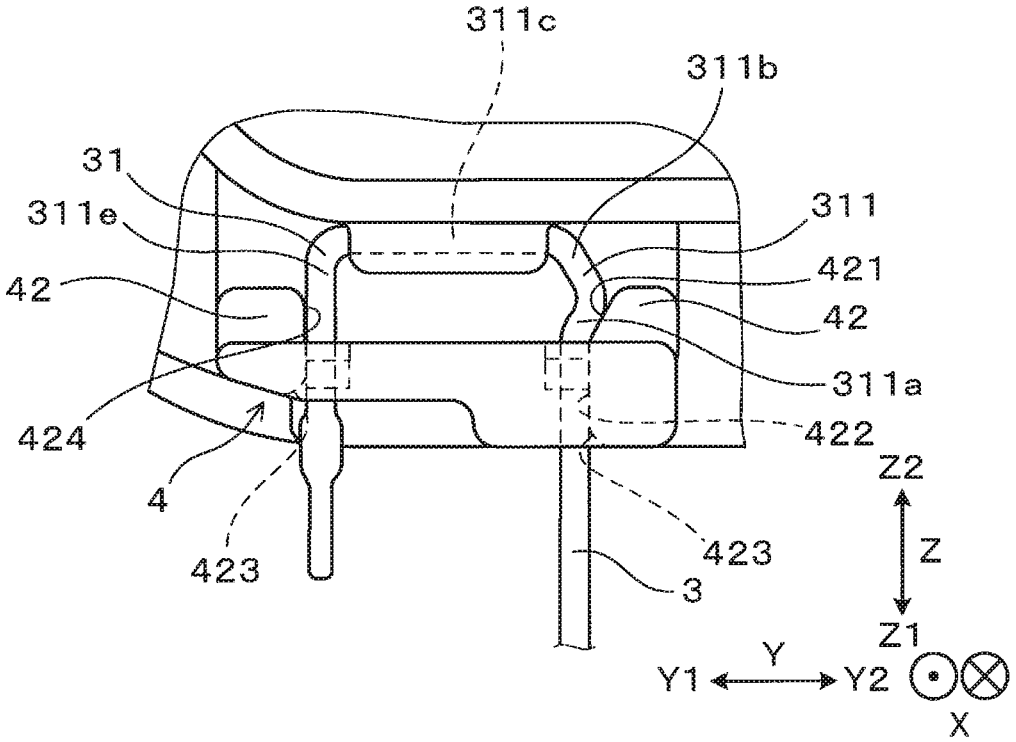
FIG. 21 is an enlarged view of a portion in the vicinity of the terminal support portion shown in FIG. 20.
Figure 22:
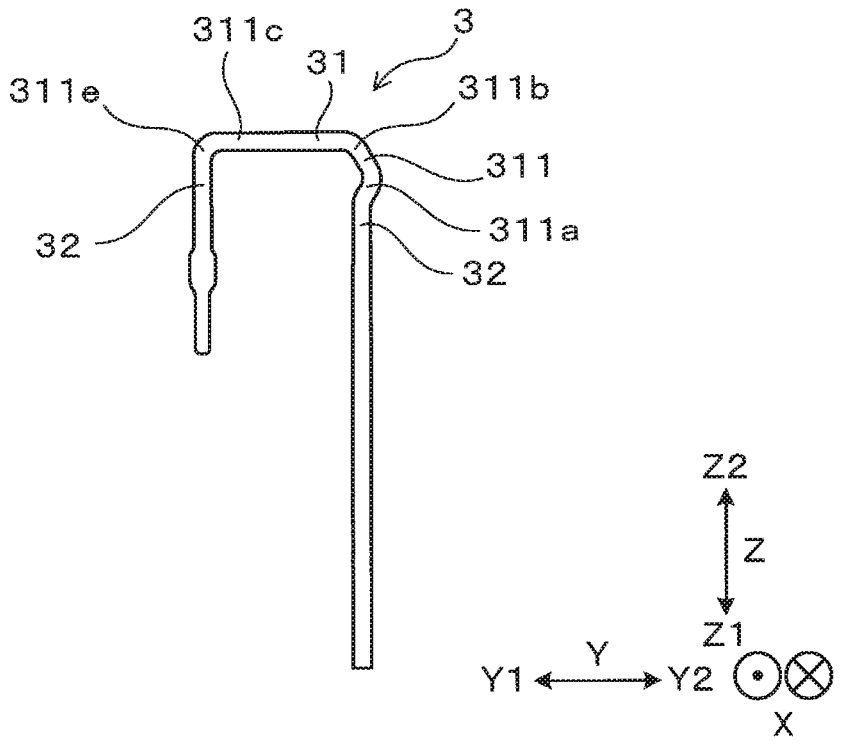
FIG. 22 is a front view of a connection portion according to the fourth embodiment.

As shown in FIGS. 20 to 22, the connection terminal 3 includes a protrusion 311 only at the Y2 side in the Y direction. A linear portion 311*e* is defined as a portion in the Y1 side of the insertion portion 32 of the pair of insertion portion 32 which extends in the Z direction. That is, the outer inclination portion 311*a* and the inner inclination portion 311*b* are not formed in the Y1 side of the inner exposed portion 31. According to the present embodiment, the terminal end portion 311*c* couples, linearly in the Y direction, the Z2 side portion of the linear portion 311*e* and the Z2 side portion of the protrusion 311 in the Y2 side.

As shown in FIG. 21, a surface in the Y2 side of the locking portion 42 of the Y1 side includes the third surface portion 423 similar to the first embodiment. A planar portion 424 formed linearly in the Z direction is defined as a region positioned in the Z2 side than the third surface portion 423 is. The planar portion 424 orthogonally crosses the Y direction and is oriented to the Y2 side. The insertion portion 32 and the linear portion 311*e* of the connection terminal 3 are press-fitted in the Y direction. On the other hand, the locking portion 42 in the Y2 side has a shape similar to the first embodiment and supports the protrusion in the Y2 side in the Z direction.

Figure 23:
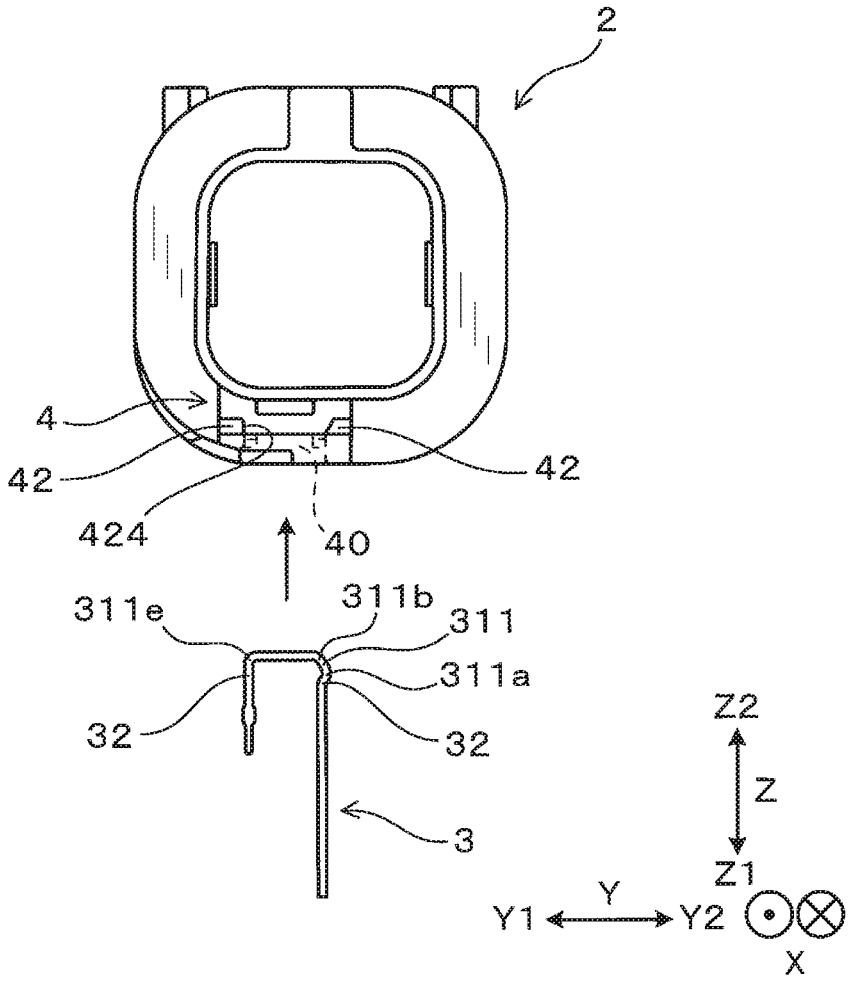
FIG. 23 is a front view of the connection terminal being mounted to the second spool in a state before bending the second spool and the terminal connection portion according to the fourth embodiment.

As shown in FIG. 23, according to the present embodiment, when the connection terminal 3 is inserted into the insertion hole portion 40, the linear portion 311*e* and the insertion portion 32 of the connection terminal 3 are arranged to be along the planar portion 424 of the locking portion 42, and the inner inclination portion 311*b* in the Y2 side of the connection terminal 3 comes into contact with the locking portion 42 in the Y2 side. Then, the connection terminal 3 is further pressed into the insertion hole portion 40 to mount the connection terminal 3 to the terminal support portion 4. At this moment, the linear portion 311*e* and the insertion portion 32 of the connection terminal 3 are pressed onto the planar portion 424, and the protrusion 311 in the Y2 side of the connection terminal 3 is bent to be shortened in the Y1 side. As a result, the inner exposed position 31 passes through the insertion hole portion 40. Other portions are the same as those in the first embodiment.

According to the present embodiment, the connection terminal 3 includes the protrusion located at a portion in either one side in the Y direction. Therefore, insertion force required for inserting the connection terminal 3 into the insertion hole portion 40 can be reduced.

In other words, when inserting the connection terminal 3 into the insertion hole portion 40, a portion, where the protrusion 311 in the Y direction of the connection terminal 3 is formed, is compressed, while a portion, where the protrusion 311 in the Y direction of the connection terminal 3 is not formed, slides on the surface of the locking portion 42. Hence, the connection terminal 3 can be mounted to the terminal support portion 4 with smaller force compared to a case where the connection terminal 3 is inserted into the insertion hole portion 40 while both sides in the Y direction of the connection terminal 3 is being compressed in the Y direction. Moreover, similar effects and advantages to that of the first embodiment can be obtained.

The present disclosure is not limited to the above-described embodiments and can be modified in various manners without departing the scope of the present disclosure.

As described in the foregoing embodiments, the ignition coil for an internal combustion engine is exemplified. In the following, conventional ignition coils of an internal combustion engine will be described.

For example, a conventional ignition coil includes, in a casing, a primary coil, a secondary coil, a second spool, a connection terminal and a high voltage output terminal. The primary coil and a secondary coil are mutually magnetically coupled. The second spool includes the secondary coil wound around an outer periphery portion thereof. For the connection terminal, an end portion of a high voltage side of the secondary coil is connected to the connection terminal. The high voltage output terminal is provided in a high voltage tower having a cylindrical shape formed projecting in a casing of the ignition coil, and connected to the connection terminal. The high voltage output terminal outputs high voltage generated at the secondary coil to the ignition plug section.

According to the above-described conventional ignition coil, the connection terminal is inserted into a groove formed in the second spool. Moreover, according to the ignition coil of the above-mentioned patent literature, after inserting the connection terminal into the groove of the second spool, a lead wire that constitutes the secondary coil is wound around the second spool by rotating the second spool.

According to the description of the above-mentioned patent literature, before the secondary coil is wound around the second spool, the connection terminal is inserted into the groove of the second spool, whereby a connection operation in which a winding end portion of the secondary coil is connected to the connection terminal after the secondary coil is wound around the second spool, can readily be automated.

However, according to the above-described conventional ignition coil, there is a concern in which the connection terminal inserted into the second spool may be detached from the second spool due to centrifugal force produced by a rotation of the second spool when winding the secondary coil. In view of an improvement of productivity of the ignition coil, when the rotational speed of the second spool is improved, the connection terminal may be detached from the second spool more easily.

In this respect, the present disclosure has been achieved in light of the above-mentioned circumstances, and is to provide an ignition coil for an internal combustion engine where the connection terminal is unlikely to detach from the second spool.

As a first aspect of the present disclosure, an ignition coil for an internal combustion engine is provided.

The ignition coil includes: a primary coil and a secondary coil magnetically coupled to each other; a second spool which the secondary coil is wound around; and a connection terminal connected to a high voltage side of the secondary coil and supported by a terminal support portion provided at the second spool. The terminal support portion includes an insertion hole portion allowing the connection terminal to be inserted in an insertion direction as a coil radial direction. The connection terminal includes a protrusion protruding outside the connection terminal in a direction orthogonally crossing the insertion direction. The protrusion is engaged to the insertion hole portion from inward in the coil radial direction.

According to the ignition coil of the internal combustion engine of the above-described aspect, the connection terminal includes a protrusion protruding outside the connection terminal in a direction perpendicular to the insertion direction. The protrusion is engaged to the insertion hole portion from inward in the coil radial direction. Therefore, the connection terminal is locked at the terminal support portion in the insertion direction and is difficult to be detach from the terminal support portion.

As described, according to the above-described aspect, an ignition coil of an internal combustion engine can be provided in which the connection terminal is unlikely to detach from the second spool.

What is claimed is:

1. An ignition coil for an internal combustion engine comprising:

a primary coil and a secondary coil magnetically coupled to each other;

a second spool which the secondary coil is wound around; and a connection terminal connected to a high voltage side of the secondary coil and supported by a terminal support portion provided at the second spool, wherein the terminal support portion includes an insertion hole portion allowing the connection terminal to be inserted in an insertion direction as a coil radial direction;

the connection terminal includes a protrusion protruding outside the connection terminal in a direction orthogonally crossing the insertion direction;

the protrusion is engaged to the insertion hole portion from inward in the coil radial direction;

the connection terminal formed by bending a metal wire material capable of being elastically deformed, in a U shape opened outwardly in the coil radial direction; and the protrusion is formed as a bending portion of a U-shaped connection terminal as and the protrusion of the connection terminal is the connection terminal formed in the U shape positioned in the insertion hole portion.

2. The ignition coil according to claim 1, wherein an inner end portion of the connection terminal in the coil radial direction includes a bending portion which is bent protruding outside the coil radial direction; and the connection terminal includes a space formed in both outsides of the bending portion in a width direction of the connection terminal.

3. The ignition coil according to claim 1, wherein the connection terminal includes the protrusion located at a portion in either side in the insertion direction.

4. The ignition coil according to claim 1, wherein an inner inclination portion is formed at an inner end portion of the protrusion in the coil radial direction, the inner inclination portion being inclined such that the closer the inner inclination portion approaches an opposite side with respect to a portion where the protrusion protrudes, the more inclined inward it is in the coil radial direction.

5. The ignition coil according to claim 1, wherein an outer inclination portion is formed at a portion in the coil radial direction of the protrusion, the outer inclination portion being inclined such that the closer inward the coil radial direction, the more inclined towards a portion where the protrusion protrudes.

6. The ignition coil according to claim 1, wherein the connection terminal is press-fitted to the insertion hole portion.

7. The ignition coil according to claim 1, wherein the terminal support portion includes a support portion that supports the connection terminal at a portion further inward in the coil radial direction in the insertion hole portion.

8. The ignition coil according to claim 1, wherein the insertion hole portion is formed in a circular shape which is opened in both sides with respect to the insertion direction.

9. The ignition coil according to claim 1, wherein the U shape of the connection terminal is formed at one end of the connection terminal in the insertion direction and a terminal connection portion of the connection terminal is formed at an opposite end of the connection terminal in the insertion direction.

10. The ignition coil according to claim 9, wherein the terminal connection portion of the connection terminal is configured to elastically contact a voltage terminal.

* * * * *